US006405717B1

(12) United States Patent
Beyer et al.

(10) Patent No.: US 6,405,717 B1
(45) Date of Patent: Jun. 18, 2002

(54) FUEL PUMP MODULE ASSEMBLY

(75) Inventors: Sharon Elizabeth Beyer, Grand Blanc; Dale Richard Jones; Bruce Albert Kuehnemund, both of Flushing; Ulf Sawert, Grand Blanc; Mark J. Hilderbrant, Fenton, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/631,065

(22) Filed: Aug. 1, 2000

(51) Int. Cl.[7] ..... F02M 37/04
(52) U.S. Cl. ..... 123/514; 123/509; 417/151
(58) Field of Search ..... 123/514, 509; 137/576; 417/151, 186

(56) References Cited

U.S. PATENT DOCUMENTS 4,461,678 A * 7/1984 Matthews et al. ..... 204/9
4,827,987 A * 5/1989 Faeth ..... 141/59
4,911,134 A * 3/1990 Olsson ..... 123/514
5,218,942 A 6/1993 Coha et al. ..... 123/514
5,330,475 A * 7/1994 Woodward et al. ..... 417/89
5,564,397 A * 10/1996 Kleppner ..... 123/514

* cited by examiner

*Primary Examiner*—Willis R. Wolfe
*Assistant Examiner*—Mahmoud Gimie
(74) *Attorney, Agent, or Firm*—Vincent A. Cichosz

(57) ABSTRACT

A fuel pump module assembly for a fuel tank in a vehicle includes a reservoir adapted to be disposed in the fuel tank having a top defining an overflow fuel level of the reservoir. The fuel pump module assembly also includes a conduit conducting return fuel from an engine of the vehicle to the reservoir and a one-piece jet pump disposed in the reservoir and having an inlet operatively connected to the conduit. The jet pump has a nozzle to discharge fuel into the reservoir.

20 Claims, 2 Drawing Sheets

FUEL PUMP MODULE ASSEMBLY

TECHNICAL FIELD

The present invention relates generally to fuel tanks for vehicles and, more particularly, to a fuel pump module assembly for a fuel tank of a vehicle.

BACKGROUND OF THE INVENTION

It is known to provide a fuel tank for a vehicle to hold fuel to be used by an engine of the vehicle. In some vehicles, the fuel tank includes a fuel pump module disposed therein with a removable cover sealed to the top of the fuel tank having an electrical connector and a fuel line outlet connector. The fuel pump module includes a fuel reservoir, an electrical fuel pump disposed in the reservoir with an inlet (not shown) at a bottom thereof and a secondary pump used to fill the reservoir to overfilling.

An example of a fuel pump module is disclosed in U.S. Pat. No. 5,218,942 to Coha et al. In this patent, the fuel pump module includes a fuel pump disposed in the reservoir, a low pressure conduit conducting hot return fuel back to the reservoir, a secondary pump disposed in the reservoir for pumping new fuel from the fuel tank into the reservoir, and a control which effects a recirculation mode of secondary pump operation when the new fuel level in the fuel tank is above a predetermined low level and a scavenge mode of secondary pump operation when the new fuel level in the reservoir is below the predetermined low level. The secondary pump includes a high-pressure jet pump having consistent flow and a float mechanism to switch the jet pump from drawing external fuel to the reservoir and vice versa.

Typically, the jet pump has an orifice molded therein that has the potential for flash at the orifice and for a plugged orifice. Alternatively, the jet pump may include a separate piece molded nozzle which press fits into a jet pump body. However, none of the nozzles in these jet pumps are press fit in the direction of pressure.

Therefore, it is desirable to provide a new fuel pump module for a fuel tank of a vehicle. It is also desirable to provide a fuel pump module having a one-piece jet pump for fuel tank of a vehicle that achieves similar performance as a separate pressed in nozzle while reducing cost, investment and failure modes. It is further desirable to provide a fuel pump module having a jet pump for a fuel tank of a vehicle that has no moving or extra parts.

SUMMARY OF THE INVENTION

It is, therefore, one object of the present invention to provide a new fuel pump module assembly for a fuel tank of a vehicle.

It is another object of the present invention to provide a fuel pump module assembly having a one-piece jet pump for a fuel tank of a vehicle.

To achieve the foregoing objects, the present invention is a fuel pump module assembly for a fuel tank in a vehicle including a reservoir adapted to be disposed in the fuel tank having a top defining an overflow fuel level of the reservoir. The fuel pump module assembly also includes a conduit conducting return fuel from an engine of the vehicle to the reservoir and a one-piece jet pump disposed in the reservoir and having an inlet operatively connected to the conduit. The jet pump has a nozzle to discharge fuel into the reservoir.

One advantage of the present invention is that a fuel pump module assembly is provided for a fuel tank in a vehicle.

Another advantage of the present invention is that the fuel pump module assembly incorporates a one-piece jet pump, reducing cost and eliminating excess componentry. Yet another advantage of the present invention is that the fuel pump module assembly integrates a one-piece jet pump that improves quality because the molded nozzle will not be subject to problems associated with molding flash. Still another advantage of the present invention is that the fuel pump module assembly improves performance because the molded nozzle reduces the return line backpressure. A further advantage of the present invention is that the fuel pump module assembly reduces investment because the jet pump is easily converted to a high-pressure jet pump by accepting a separate piece orifice. Yet a further advantage of the present invention is that the fuel pump module assembly has a one-piece jet pump that achieves the same performance as a separate pressed in nozzle while reducing cost and investment and eliminating failure modes.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
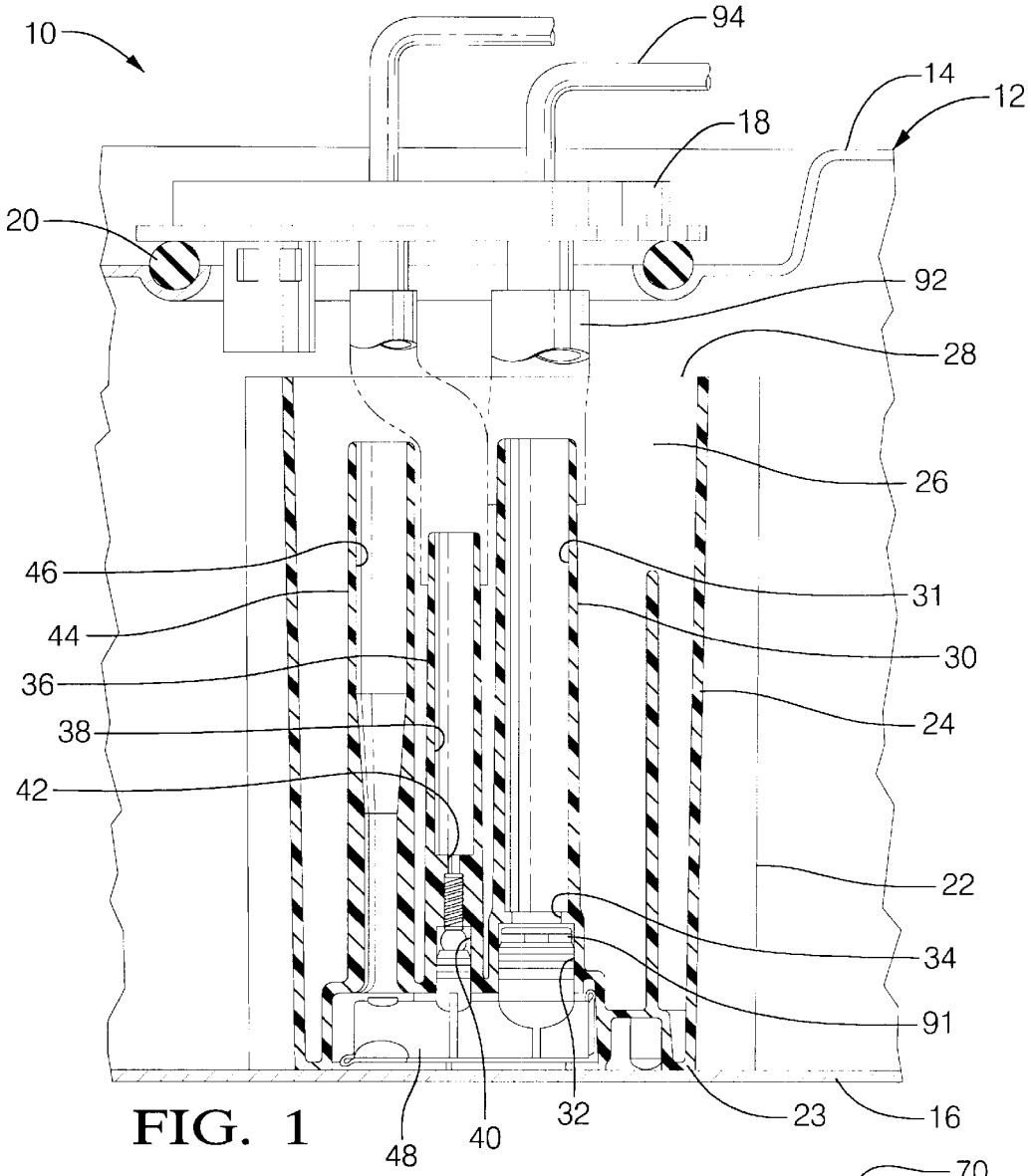
FIG. 1 is a fragmentary elevational view of a fuel pump module assembly, according to the present invention, illustrated in operational relationship with a fuel tank of a vehicle.
Figure 2:
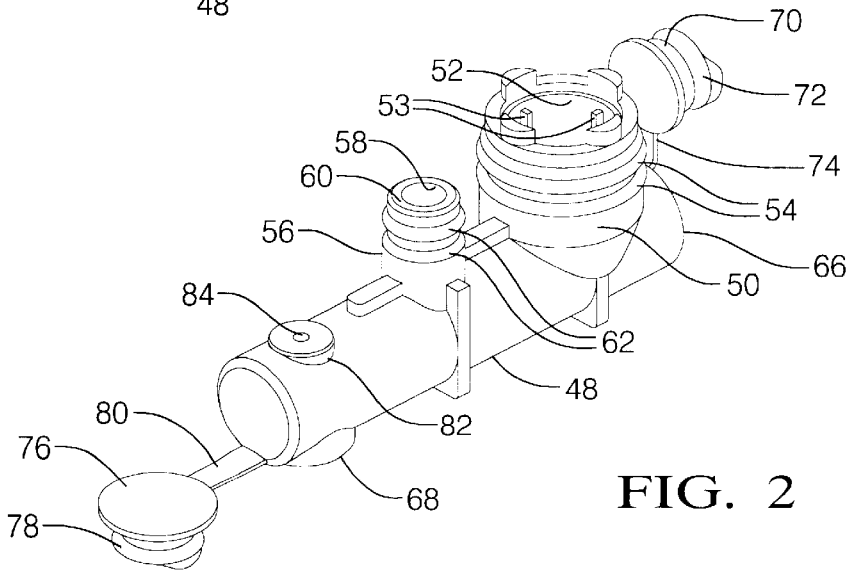
FIG. 2 is a perspective view of a one-piece jet pump, according to the present invention, of the fuel pump module assembly of FIG. 1.
Figure 3:
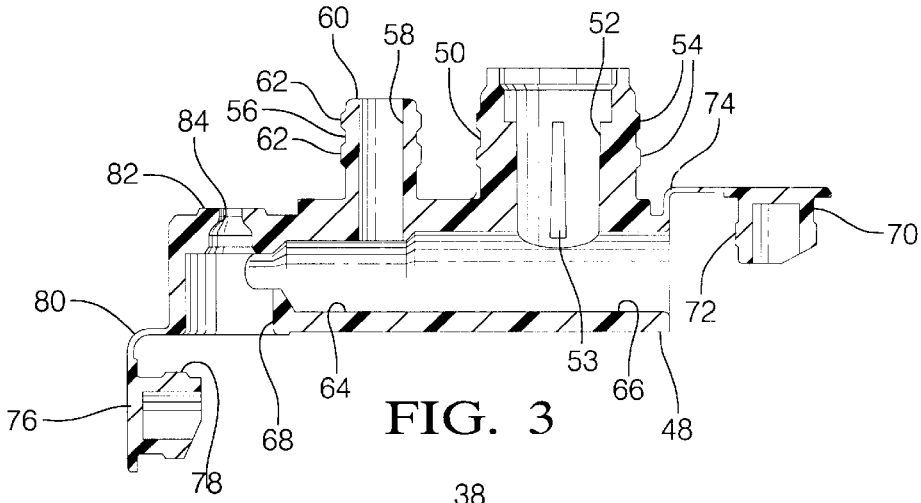
FIG. 3 is a fragmentary elevational view of the one-piece jet pump of FIG. 2 as molded.

Referring to the drawings and in particular FIGS. 1 and 2, one embodiment of a fuel pump module assembly 10, according to the present invention, is shown for a fuel tank, generally indicated at 12, in a vehicle (not shown). The fuel tank 12 has an upper wall 14 and a lower wall 16. The fuel pump module assembly 10 is disposed in the fuel tank 12 and has a removable cover 18 sealed by a seal ring 20 to the upper wall 14 of the fuel tank 12. It should be appreciated that, except for the fuel pump module assembly 10, the fuel tank 12 is conventional and known in the art.

Figure 4:
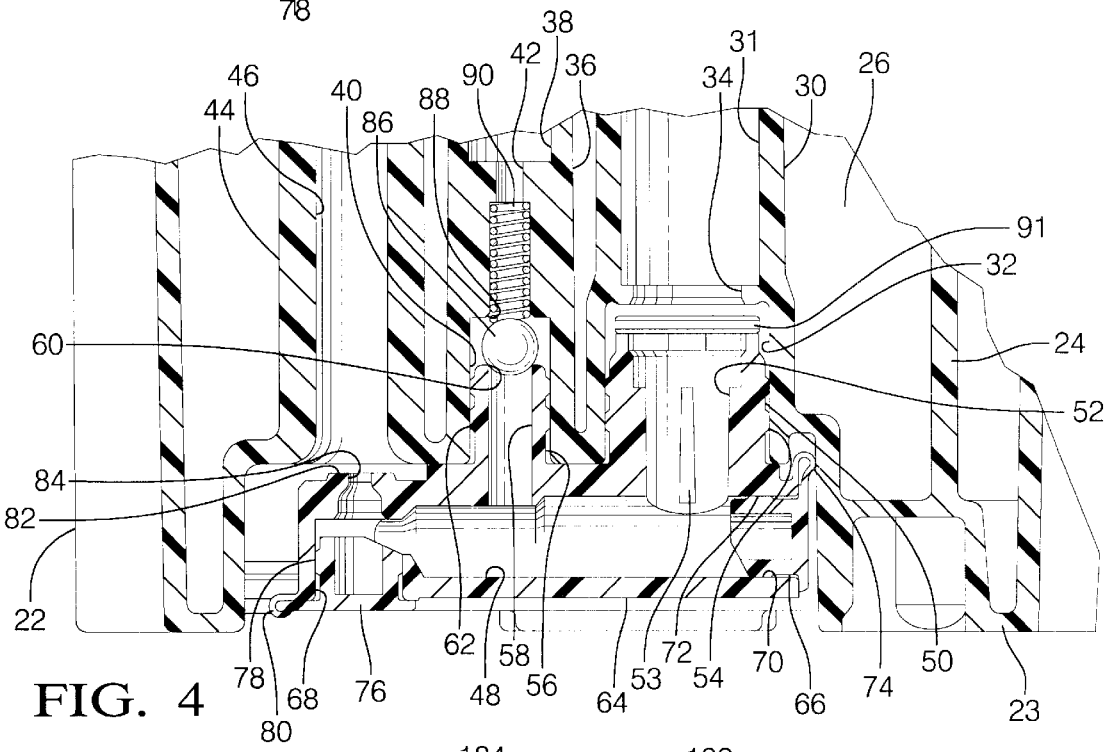
FIG. 4 is an enlarged partial fragmentary elevational view of the fuel pump module assembly of FIG. 1 with the one-piece jet pump of FIG. 2 in an assembled state.

Referring to FIGS. 1 and 4, the fuel pump module assembly 10 includes a fuel reservoir 22 to hold fuel disposed inside the fuel tank 12. The fuel reservoir 22 has a bottom portion 23 and an annular side portion 24 extending generally perpendicularly from the bottom portion 23 to form a chamber 26. The fuel reservoir 22 is generally bucket-shaped and open at a top end 28 thereof, which defines an overflow fuel level in the fuel reservoir 22.

The fuel pump module assembly 10 also includes a return fuel member 30 extending upwardly from the bottom portion 23 of the fuel reservoir 22. The return fuel member 30 is tubular and has a generally circular cross-sectional shape.

The return fuel member 30 has a passageway 31 extending axially therethrough. The return fuel member 30 has a cavity 32 in a bottom thereof and aperture 34 interconnecting the passageway 31 and the cavity 32. The return fuel member 30 is integral and formed as one-piece with the fuel reservoir 22. It should be appreciated that the return fuel member 30 extends into the chamber 26 of the fuel reservoir 22.

The fuel pump module assembly 10 includes an overpressure relief member 36 extending upwardly from the bottom portion 23 of the fuel reservoir 22. The overpressure relief member 36 is tubular and has a generally circular cross-sectional shape. The overpressure relief member 36 has a passageway 38 extending axially therethrough. The overpressure relief member 36 has a cavity 40 in a bottom thereof and aperture 42 interconnecting the passageway 38 and the cavity 40. The overpressure relief member 36 is integral and formed as one-piece with the fuel reservoir 22. It should be appreciated that the overpressure relief member 36 extends into the chamber 26 of the fuel reservoir 22.

The fuel pump module assembly 10 also includes a mixing chamber member 44 extending upwardly from the bottom portion 23 of the fuel reservoir 22. The mixing chamber member 44 is tubular and has a generally circular cross-sectional shape. The mixing chamber member 44 has a passageway 46 extending axially therethrough. The mixing chamber member 44 is integral and formed as one-piece with the fuel reservoir 22. It should be appreciated that the mixing chamber member 44 extends into the chamber 26 of the fuel reservoir 22.

The fuel pump module assembly 10 also includes a one-piece secondary or jet pump 48 cooperating with the overpressure relief member 36, mixing chamber member 44 and return fuel member 30. The jet pump 48 is tubular in shape with a generally circular cross-section. The jet pump 48 has a first projection 50 extending outwardly and disposed in the cavity 32 of the fuel return member 30. The first projection 50 is generally tubular in shape with a generally circular cross-sectional shape. The first projection 50 has an aperture 52 extending therethrough. The first projection 50 may include a plurality of axially extending and circumferentially spaced inner ribs 53 in the aperture 52. The first projection 50 has a plurality of annular spaced outer ribs 54 on an outer surface thereof to engage an inner surface of the cavity 32. The jet pump 48 has a second projection 56 extending outwardly and spaced laterally from the first projection 50 and disposed in the cavity 40 of the overpressure relief member 36. The second projection 56 is generally tubular in shape with a generally circular cross-sectional shape. The second projection 56 has an aperture 58 extending therethrough. The second projection 56 has a seat 60 formed at the free end thereof for a function to be described. The second projection 56 has a plurality of annular spaced outer ribs 62 on an outer surface thereof to engage an inner surface of the cavity 40. The jet pump 48 has a chamber 64 communicating with the apertures 52 and 58 and having a first open end 66 at one axial end thereof and a second open end 68 at a bottom thereof near the other axial end. The jet pump 48 has a first plug 70 closing the first open end 66. The first plug 70 has an annular rib 72 to secure the first plug 70 in the first open end 66 and a tether 74 connecting the first plug 70 to the jet pump 48. The jet pump 48 has a second plug 76 closing the second open end 68. The second plug 76 has an annular rib 78 to secure the second plug 76 in the second open end 68 and a tether 80 connecting the second plug 76 to the jet pump 48. The jet pump 48 has a molded nozzle 82 having a passageway 84 extending therethrough and communicating with the passageway 46 of the mixing chamber member 44. The jet pump 48 is molded of a suitable plastic material such as acetyl by conventional injection molding. The jet pump 48 is a monolithic structure being integral, unitary and one-piece. It should be appreciated that the plugs 70 and 76 are molded as part of the jet pump 48.

The fuel pump module assembly 10 may include a pressure relief valve 86 disposed in the cavity 40 of the overpressure relief member 36 and cooperating with the seat 60 on the jet pump 48 and a seat 88 on the jet pump member 36. The fuel pump module assembly 10 may also include a spring 90 such as a coil spring disposed in the cavity 40 between the pressure relief valve 86 and the overpressure relief member 36 to urge the pressure relief valve 86 toward the seat 60 on the jet pump 48.

The fuel pump module assembly 10 may include a reverse flow check valve 91 disposed in the cavity 34 adjacent the first projection 50 of the jet pump 48. The reverse flow check valve 91 is generally circular in shape and covers the aperture 52 to prevent fuel from being siphoned from the jet pump 48.

The fuel pump module assembly 10 also includes a conduit or hose 92 connected to one end of the fuel return member 30 and a fuel connector 94 extending through the cover 18. It should be appreciated that the fuel connector 84 returns fuel to the fuel pump module assembly 10.

In operation, the fuel pump module assembly 10 is illustrated in an assembled state in FIG. 1. Fuel from the engine returns via the fuel connector 94 and hose 92 to the return fuel member 30. Fuel flows through the passageway 31 and aperture 34 of the fuel return member 30 to the jet pump 48. In the jet pump 48, fuel flows through the aperture 52 in the first projection 50 to the chamber 64 and through the passageway 84 in the nozzle 82 to the mixing chamber member 44. Fuel flows through the passageway 46 of the mixing chamber member 44 and into the chamber 26 of the reservoir 22 to fill the reservoir 22. As the fuel pressure rises in the jet pump 48, the pressure relief valve 86 rises off the seat 60 against the spring 90 and opening the aperture 42 in the overpressure relief member 36 to relieve pressure in the jet pump 48. As a result, fuel is relieved from the jet pump 48 through the aperture 42 and into the passageway 38 of the overpressure relief member 36 to flow to the engine of the vehicle. It should be appreciated that fuel being returned from the engine or fuel being by-passed by a fuel regulator (not shown) has a variable flow to the jet pump 48 because of the fuel being used by the engine. It should also be appreciated that the vacuum being generated by the jet pump 48 is continuously varying. It should be appreciated that the molded nozzle 82 reduces system backpressure created with the use of the jet pump 48. It should further be appreciated that molding of the nozzle 82 instead of an orifice results in a higher quality part because the potential for flash at the orifice is eliminated and the failure mode of a plugged orifice is also eliminated.

Figure 5:
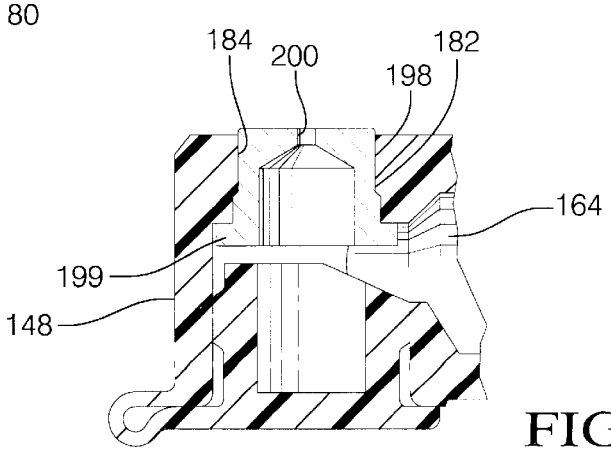
FIG. 5 is an enlarged partial fragmentary view of another embodiment, according to the present invention, of the one-piece jet pump of FIG. 2 for the fuel pump module assembly of FIG. 1.

Referring to FIG. 5, another embodiment 148, according to the present invention, of the one-piece jet pump 48 is shown. Like parts of the jet pump 48 have like reference numerals increased by one hundred (100). In this embodiment, the jet pump 148 may be of a high-pressure type by including a nozzle/orifice insert 198 disposed in the passageway 184 of the nozzle 182. The orifice insert 198 is generally circular in shape. The orifice insert 198 is press-fit into the passageway 184 of the nozzle 182. The orifice insert 198 has a flange 199 extending radially and disposed in the chamber 164 to prevent the insert 198 from exiting the passageway 184. The orifice insert 198 also has an orifice 200 to allow fuel to pass therethrough and has a predetermined diameter, for example, such as 0.015 inches. The orifice insert 198 is made of a metal material such as machined brass. It should be appreciated that the operation of the jet pump 148 is similar to the jet pump 48, except that the jet pump 148 is of a high-pressure type. It should also be appreciated that the press of the machined nozzle or orifice insert 198 is such that a failure mode of the press fit is eliminated because the press is in the direction that the fuel pressure is applied.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A fuel pump module assembly for a fuel tank in a vehicle comprising:

a reservoir adapted to be disposed in the fuel tank having a top defining an overflow fuel level of said reservoir;

a conduit conducting return fuel from an engine of the vehicle to said reservoir;

a one-piece jet pump extending longitudinally disposed in said reservoir and having an inlet operatively connected to said conduit; and said jet pump having a molded nozzle extending generally perpendicularly therefrom to discharge fuel into said reservoir.

2. A fuel pump module assembly as set forth in claim 1 including a mixing chamber member extending into said chamber and operatively connected to said nozzle.

3. A fuel pump module assembly as set forth in claim 2 wherein said mixing chamber member has a passageway extending therethrough and parallel to an axis of said nozzle.

4. A fuel pump module assembly as set forth in claim 1 wherein said reservoir forms a chamber and includes a return fuel member extending into said chamber and connected to said conduit.

5. A fuel pump module assembly as set forth in claim 4 wherein said jet pump has at least one projection extending therefrom and connected to said return fuel member.

6. A fuel pump module assembly as set forth in claim 2 wherein said reservoir includes an overpressure relief member extending into said chamber and cooperating with said jet pump.

7. A fuel pump module assembly as set forth in claim 1 including an orifice insert being made of a metal material disposed in said passageway of said nozzle to discharge fuel at a high pressure into said fuel reservoir.

8. A fuel pump module assembly for a fuel tank in a vehicle comprising:

a reservoir adapted to be disposed in the fuel tank having a top defining an overflow fuel level of said reservoir;

a conduit conducting return fuel from an engine of the vehicle to said reservoir;

a one-piece jet pump disposed in said reservoir and having an inlet operatively connected to said conduit;

said jet pump having a nozzle to discharge fuel into said reservoir; and wherein said jet pump has at least one opening in an end thereof and a plug connected to said jet pump to close said at least one opening.

9. A fuel pump module assembly for a fuel tank in a vehicle comprising:

a reservoir adapted to be disposed in the fuel tank having a top defining an overflow fuel level of said reservoir;

a conduit conducting return fuel from an engine of the vehicle to said reservoir;

a one-piece jet pump disposed in said reservoir and having an inlet operatively connected to said conduit; and said jet pump having a nozzle to discharge fuel into said reservoir;

wherein said reservoir forms a chamber and includes a return fuel member extending into said chamber and connected to said conduit;

wherein said jet pump has at least one projection extending therefrom and connected to said return fuel member; and wherein said return fuel member has a passageway extending therethrough, a cavity to receive said at least one projection of said jet pump and an aperture extending between said passageway and said cavity.

10. A fuel pump module assembly for a fuel tank in a vehicle comprising:

a reservoir adapted to be disposed in the fuel tank having a top defining an overflow fuel level of said reservoir;

a conduit conducting return fuel from an engine of the vehicle to said reservoir;

a one-piece jet pump disposed in said reservoir and having an inlet operatively connected to said conduit;

said jet pump having a nozzle to discharge fuel into said reservoir;

a mixing chamber member extending into said chamber and operatively connected to said nozzle;

wherein said reservoir includes an overpressure relief member extending into said chamber and cooperating with said jet pump; and wherein said overpressure relief member has a passageway extending therethrough, a cavity to receive a discharge outlet of said jet pump and an aperture extending between said passageway and said cavity.

11. A fuel pump module assembly as set forth in claim 10 including a pressure relief valve disposed in said cavity of said overpressure relief member.

12. A fuel pump module assembly for a fuel tank in a vehicle comprising:

a reservoir adapted to be disposed in the fuel tank having a top defining an overflow fuel level of said reservoir;

a conduit conducting return fuel from an engine of the vehicle to said reservoir;

said reservoir forming a chamber and including a return fuel member extending into said chamber and connected to said conduit;

said reservoir including an overpressure relief member extending into said chamber;

a one-piece jet pump extending longitudinally disposed in said reservoir and having an inlet operatively connected to said return fuel member and an outlet operatively connected to said overpressure relief member; and said jet pump having a molded nozzle extending generally perpendicularly therefrom to discharge fuel into said reservoir.

13. A fuel pump module assembly as set forth in claim 12 including a mixing chamber member extending into said chamber and operatively connected to said nozzle.

14. A fuel pump module assembly as set forth in claim 13 wherein said mixing chamber member has a passageway extending therethrough and parallel to an axis of said nozzle.

15. A fuel pump module assembly as set forth in claim 12 wherein said jet jump has at least one projection extending therefrom and connected to said return fuel member.

16. A fuel pump module assembly as set forth in claim 12 wherein said jet jump is a monolithic structure.

17. A fuel pump module assembly as set forth in claim 12 including an orifice insert being made of a metal material disposed in said passageway of said nozzle to discharge fuel at a high pressure into said fuel reservoir.

18. A fuel pump module assembly for a fuel tank in a vehicle comprising:

a reservoir adapted to be disposed in the fuel tank having a top defining an overflow fuel level of said reservoir;

a conduit conducting return fuel from an engine of the vehicle to said reservoir;

said reservoir forming a chamber and including a return fuel member extending into said chamber and connected to said conduit;

said reservoir including an overpressure relief member extending into said chamber;

a one-piece jet pump disposed in said reservoir and having an inlet operatively connected to said return fuel member and an outlet operatively connected to said overpressure relief member; and said jet pump having a nozzle to discharge fuel into said reservoir; and wherein said jet pump has at least one opening in an end thereof and a plug connected to said jet pump to close said at least one opening.

19. A fuel pump module assembly as set forth in claim 18 wherein said reservoir forms a chamber and includes a return fuel member extending into said chamber and connected to said conduit.

20. A fuel tank assembly for a vehicle comprising:

a fuel tank;

a fuel reservoir disposed in said fuel tank having a top defining an overflow fuel level of said reservoir;

a conduit conducting return fuel from an engine of the vehicle to said reservoir;

said reservoir forming a chamber and including a return fuel member extending into said chamber and connected to said conduit;

said reservoir including an overpressure relief member extending into said chamber;

a one-piece jet pump disposed in said reservoir and having an inlet operatively connected to said return fuel member and an outlet operatively connected to said overpressure relief member;

a mixing chamber member extending upwardly into said chamber and operatively connected to said jet pump; and said jet pump having a molded nozzle extending upwardly and having a first passageway extending therethrough to discharge fuel into said reservoir, wherein said mixing chamber member has a second passageway extending therethrough and parallel to and communicating with said first passageway of said nozzle.

* * * * *